United States Patent [19]

Miller

[11] Patent Number: 4,683,765

[45] Date of Patent: Aug. 4, 1987

[54] VARIABLE DISPLACEMENT WOBBLE PLATE COMPRESSOR GUIDE ROD MOUNTING ARRANGEMENT

[75] Inventor: Gary T. Miller, E. Amherst, N.Y.

[73] Assignee: General Motors Corporation, Detroit, Mich.

[21] Appl. No.: 882,789

[22] Filed: Jul. 7, 1986

[51] Int. Cl.[4] ..... F04B 1/28; F16H 23/04

[52] U.S. Cl. ..... 74/60; 417/222; 417/269

[58] Field of Search ..... 74/60; 417/222, 269, 417/270; 91/505, 506; 92/12.2

[56] References Cited

U.S. PATENT DOCUMENTS

| | | | |
|---|---|---|---|
| 2,040,390 | 5/1936 | Loe | 74/60 |
| 2,106,236 | 1/1938 | Burke | 74/60 |
| 4,297,085 | 10/1981 | Brucken | 417/222 |
| 4,428,718 | 1/1984 | Skinner | 417/222 |
| 4,480,964 | 11/1984 | Skinner | 417/222 |
| 4,606,705 | 8/1986 | Parekh | 417/222 |

FOREIGN PATENT DOCUMENTS

| | | | |
|---|---|---|---|
| 1026239 | 2/1953 | France | 74/60 |
| 237478 | 7/1925 | United Kingdom | 74/60 |

*Primary Examiner*—Lawrence Staab
*Attorney, Agent, or Firm*—R. L. Phillips

[57] ABSTRACT

A variable displacement wobble plate compressor is disclosed having vibration isolation mounting cups supporting the opposite ends of a guide rod that operates through a multiple axis joint to prevent rotation while permitting angulation of the wobble plate.

2 Claims, 4 Drawing Figures

VARIABLE DISPLACEMENT WOBBLE PLATE COMPRESSOR GUIDE ROD MOUNTING ARRANGEMENT

TECHNICAL FIELD

This invention relates to variable displacement wobble plate compressors and more particularly to the mounting therein of the guide rod that operates to prevent rotation while permitting angulation of the wobble plate.

BACKGROUND OF THE INVENTION

In a variable displacement wobble plate compressor such as that used in motor vehicle air conditioning systems, there is noise from vibration in the compressor's mechanisms. These mechanism noise levels will in general vary with the manufacturing tolerances and can be reduced by reducing their limits. This solution, while being capable of lowering the noise to acceptable levels, does not, however, attack the crux of the problem which in compressors of the above kind have been difficult to isolate.

SUMMARY OF THE INVENTION

The present invention results from my discovery that the guide rod in a variable displacement wobble plate compressor is a primary noise conspirator. Typically, this guide rod is press-fitted at one end into a cylinder block, has a multiple axis sliding joint connection with the wobble plate and is slip-fitted at the opposite end into the compressor's crankcase that encloses the wobble plate mechanism. I have discovered that vibration is transferred from the cylinder block to the guide rod and thence through the multiple axis joint to the wobble plate mechanism where it is then amplified by the crankcase and externally discerned as noise. Having identified this situation, the present invention provides a simple solution in the form of vibration isolating cups made of a vibration damping material to support the ends of the guide rod in the cylinder block and crankcase. The vibration isolating cups do not interfere with the wobble plate and guide rod joint while isolating the guide rod ends from their respective mountings in the cylinder block and crankcase to thereby substantially reduce vibration within the latter and thus the emission of noise.

DESCRIPTION OF THE PREFERRED EMBODIMENT

These and other objects, advantages and features of the present invention will become more apparent from the following description and drawing in which.

Figure 1:
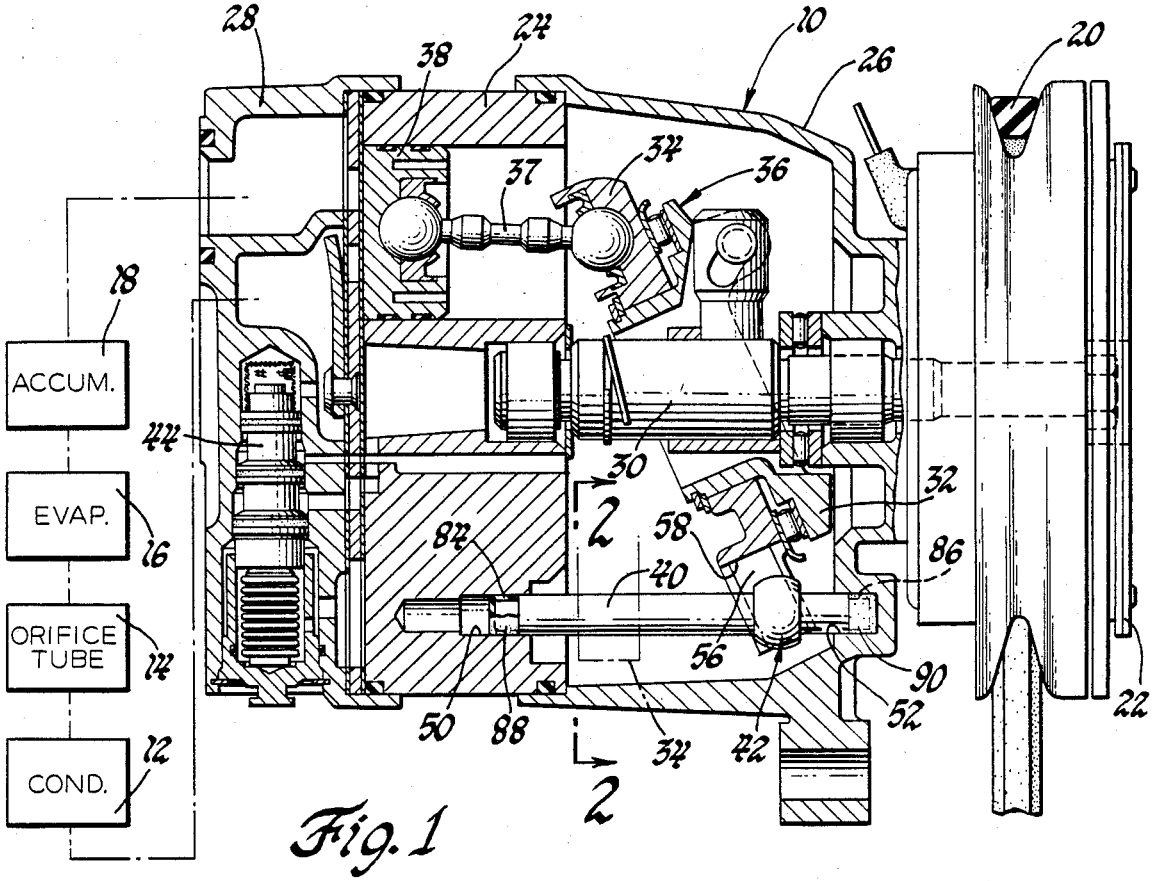
FIG. 1 is a longitudinal sectional view of a variable displacement wobble plate compressor having incorporated therein the preferred embodiment of the noise isolation arrangement of the present invention. This figure further includes a schematic of a motor vehicle air conditioning system in which the compressor is connected.

Referring to the drawings wherein the same numbers are employed to identify the same parts throughout the several views, there is shown in FIG. 1 a variable displacement wobble plate compressor 10 adapted for use as a refrigerant compressor and connected in a motor vehicle air conditioning system having the normal condenser 12, orifice tube 14, evaporator 16 and accumulator 18 arranged in that order between the compressor's discharge and suction sides. The compressor is driven by the motor vehicle's engine (not shown) through a V-belt 20 and an electromagnetic clutch 22 and comprises a cylinder block 24 that is closed at one end by a crankcase 26 and at the other end by a cylinder head 28. A drive shaft 30 connected to the output of the clutch is rotatably mounted in the cylinder block and crankcase and drives a drive plate 32 that in turn wobbles a wobble plate 34 in the compressor's wobble plate mechanism 36 that is enclosed by the crankcase. The wobble plate 34 operates through ball-ended connecting rods 37 to drive five pistons 38 mounted in the cylinder block (only one rod and piston being shown). A round guide rod or pin 40 mounted in the compressor parallel to the drive shaft operates through a multiple axis joint 42 to prevent rotation of the wobble plate to enable its wobble action while permitting angulation of the wobble plate from the full stroke position shown in solid line in FIG. 1 to a minimum stroke position shown by the phantom line in this same view to vary the displacement. A control valve 44 mounted in the cylinder head 28 responds to both suction and discharge pressure to control the pressure differential between the crankcase and the suction pressure and thereby control the angle of the wobble plate and thus the displacement of the compressor. The compressor structure thus far described is like that disclosed in U.S. Pat. Nos. 4,297,085 and 4,428,718 assigned to the assignee of this invention and which are hereby incorporated by reference.

In such prior compressor structure and particularly with respect to the guide rod and multiple axis joint, the guide rod 40 would typically be press-fitted in a blind bore 50 in the cylinder block and slip-fitted in a blind bore 52 in the crankcase 26. Furthermore, the multiple axis joint 42 through which the guide rod operates comprises a pair of opposed, concave, semi-cylindrical, radially extending guides 54 and 56 formed in a radial slot 58 in the wobble plate through which the guide rod passes. A spherical bearing body 60 having a central bore 62 that slidably receives the guide rod has its spherical convex surface 64 received on opposite sides in a spherical socket 66 and 68 formed in guide shoe members 70 and 72, respectively. In addition, the shoe members 70 and 72 have a semi-cylindrical outer surface 74 and 76, respectively, that is slidably received by the respective guides 54 and 56. Moreover, the shoe members 70 and 72 are configured about their respective socket 66 and 68 with a planar surface 78 and 80 that slidably bears on the guide rod so as to maintain the shoe members in substantially parallel planes. And thus in the above joint, the guide shoes are free to reciprocate radially in their associated guide and reciprocate longitudinally along the guide rod together with the bearing body to prevent rotation of the wobble plate while permitting angulation thereof.

In the above compressor structure, it has been found that vibration is transmitted from the cylinder block 24 to the guide rod 40 and that the latter in turn transmits the vibration through the multiple axis joint 42 to the wobble plate mechanism 36 where it is amplified by the surrounding crankcase 26 and externally discerned as noise by the vehicle occupants.

Figure 2:
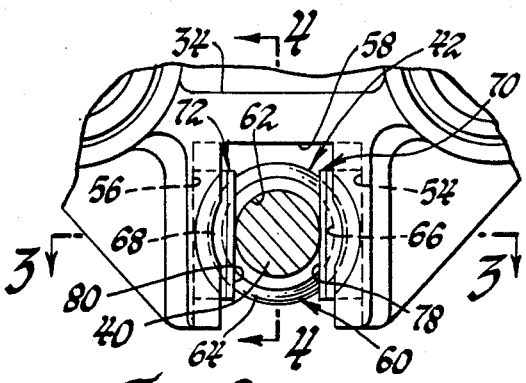
FIG. 2 is an enlarged view taken along the line 2—2 in FIG. 1.
Figure 3:
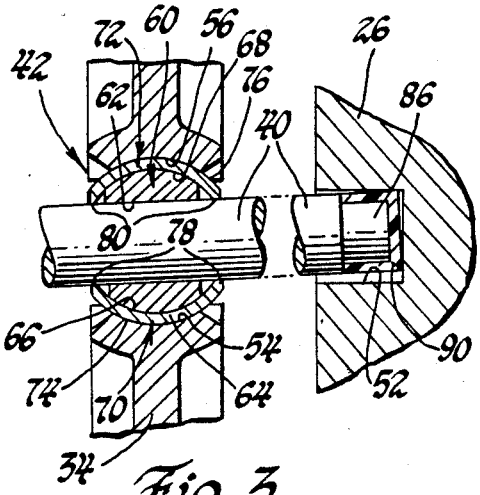
FIG. 3 is a view taken along the line 3—3 in FIG. 2.
Figure 4:
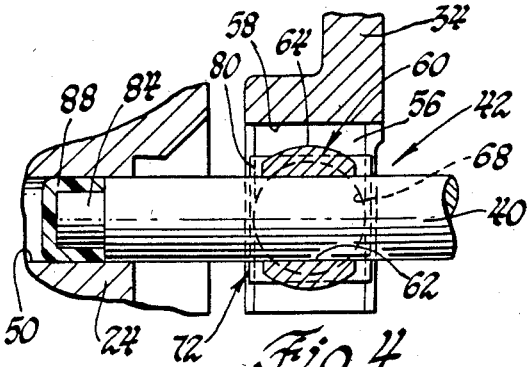
FIG. 4 is a view taken along the line 4—4 in FIG. 2.

According to the present invention and as best seen in FIGS. 2–4, the opposite ends of the guide rod 40 are provided with a reduced diameter portion 84 and 86 onto which is pressed a vibration isolation cup 88 and 90, respectively, made from a plastic vibration damping material such as polyimide. The outer diameter of the cups is made the same as that of the guide rod so that the cup 88 press fits along with the guide rod into the blind bore 50 in the cylinder block 24 while the other cup 90 slip fits along with the guide rod into the blind bore 52 in the crankcase 26. This latter fit is exaggerated in FIG. 3 to illustrate the slip fit clearance of the guide rod and cup 90 in the crankcase 26. As a result and upon vibration transmission from the cylinder block 24 to the guide rod, the latter will, as viewed in FIG. 1, pivot about its left end in the cup 84 and the other cup 86 will, as shown in FIG. 3, cross the clearance and cushionly engage opposite sides of the bore 52 thus dampening out the vibration prior to reaching the wobble plate mechanism and the crankcase. Furthermore, it will be appreciated that the cups are located so as not to interfere with the multiple axis joint 42 while remaining active to isolate the guide rod from the cylinder block and crankcase to reduce the vibration and noise transmission.

The above described preferred embodiment is illustrative of the invention which may be modified within the scope of the appended claims.

The embodiments of the invention in which an exclusive property or privilege is claimed are defined as follows:

1. In a variable displacement wobble plate compressor having a guide rod that is mounted at opposite ends thereof in the compressor and operates through a multiple axis joint to prevent rotation while permitting angulation of a wobble plate, the improvement comprising vibration isolation mounting means formed of a vibration dampening material for mounting the opposite ends of the guide rod in the compressor.

2. In a variable displacement wobble plate compressor having a guide rod that is mounted at opposite ends thereof in a cylinder block and crankcase and operates through a multiple axis joint to prevent rotation while permitting angulation of a wobble plate, the improvement comprising a vibration isolation mounting cup formed of vibration dampening material received on a reduced diameter portion on one end of the guide rod and press fit together with an adjoining portion of the guide rod in a bore in the cylinder block, and a vibration isolation mounting cup formed of vibration damping material received on a reduced diameter portion on the other end of the guide rod and received together with an adjoining portion of the guide rod with clearance in a bore in the crankcase.

* * * * *